US012669114B2

(12) United States Patent
Yoon et al.

(10) Patent No.: US 12,669,114 B2
(45) Date of Patent: Jun. 30, 2026

(54) ENERGY-EFFICIENT ELECTROMAGNETIC MICROPUMP SYSTEM

(71) Applicant: UIF (University Industry Foundation), Yonsei University, Seoul (KR)

(72) Inventors: Jun Young Yoon, Seoul (KR); Jae Woo Jung, Seoul (KR); Eun Kyu Kim, Seoul (KR); Hyeong Min Yoon, Gyeonggi-do (KR); Jae Hyun Kim, Seoul (KR); Hyo Geon Lee, Gyeonggi-do (KR); Bo Min Kang, Seoul (KR)

(73) Assignee: UIF (UNIVERSITY INDUSTRY FOUNDATION, YONSEI UNIVERSITY, Seoul (KR)

( * ) Notice: Subject to any disclaimer, the term of this patent is extended or adjusted under 35 U.S.C. 154(b) by 383 days.

(21) Appl. No.: 18/337,752

(22) Filed: Jun. 20, 2023

(65) Prior Publication Data

US 2023/0417234 A1 Dec. 28, 2023

(30) Foreign Application Priority Data

Jun. 22, 2022 (KR) ..... 10-2022-0076059

(51) Int. Cl.
*F04B 43/09* (2006.01)
*F04B 43/08* (2006.01)
*F04B 53/10* (2006.01)

(52) U.S. Cl.
CPC ..... *F04B 43/09* (2013.01); *F04B 43/086* (2013.01); *F04B 53/10* (2013.01)

(58) Field of Classification Search
CPC ..... F04B 43/09; F04B 43/086; F04B 53/10; F04B 19/006; A61M 5/14216; A61M 2205/8287
See application file for complete search history.

(56) References Cited

U.S. PATENT DOCUMENTS 4,437,815 A * 3/1984 McMullen ..... A61M 5/14276 604/152
4,519,792 A * 5/1985 Dawe ..... A61M 5/14216 604/152

(Continued)

FOREIGN PATENT DOCUMENTS

JP 2013051777 3/2013
JP 2020091402 6/2020

(Continued)

OTHER PUBLICATIONS

Raw Machine Translation of KR 2007/0006623 A, Baek , "Solenoid Pressure Valve" (Year: 2007).*

(Continued)

*Primary Examiner* — Essama Omgba
*Assistant Examiner* — Lilya Pekarskaya
(74) *Attorney, Agent, or Firm* — Tarolli, Sundheim, Covell & Tummino LLP

(57) ABSTRACT

Proposed is a micropump. The micropump includes a head portion including a first and second movement guides and a first tip, and includes a body portion having at least a portion thereof accommodated in the head portion, the body portion including a core, a winding body, a first permanent magnet, a second permanent magnet, a first fixing guide, and a second fixing guide. The first movement guide and the first fixing guide are famed so as to correspond to each other, the second movement guide and the second fixing guide are formed so as to correspond to each other, a pole of the first permanent magnet faces or opposes a lower end contact surface of the core, and a facing direction of a pole of the second permanent magnet is same as a facing direction of the first permanent magnet.

5 Claims, 19 Drawing Sheets

(56) References Cited

U.S. PATENT DOCUMENTS

| | | | | |
|---|---|---|---|---|
| 5,073,095 | A * | 12/1991 | Thomas, Sr. | F04B 17/046 335/257 |
| 10,428,808 | B2 * | 10/2019 | Humburg | F04B 49/225 |
| 2005/0025638 | A1 * | 2/2005 | Buffet | F04B 17/046 417/416 |
| 2005/0069436 | A1 * | 3/2005 | Shibasaki | A61M 60/279 417/474 |

FOREIGN PATENT DOCUMENTS

| | | | | |
|---|---|---|---|---|
| KR | 20070006623 | A * | 1/2007 | F04B 35/045 |
| KR | 1020160010101 | | 8/2017 | |

OTHER PUBLICATIONS

Raw Machine Translation of KR20170089639 A, Lee Eung Suk et al , "Micro Pump" (Year: 2017).*

Kaoru Uesugi et al., "Survival Rate of Cells Sent by a Low Mechanical Load Tube Pump: The Ring Pump" Micromachines 2020.

* cited by examiner

ENERGY-EFFICIENT ELECTROMAGNETIC MICROPUMP SYSTEM

CROSS REFERENCE TO RELATED APPLICATION

The present application claims priority to Korean Patent Application No. 10-2022-0076059, filed on Jun. 22, 2022, the entire contents of which are incorporated herein for all purposes by this reference.

BACKGROUND OF THE INVENTION

Field of the Invention

The present disclosure relates to a micropump. More particularly, the present disclosure relates to a micropump having low power consumption and having a small size.

Description of the Related Art

A micropump capable of transferring a small amount of fluid that is disposed in a tube is used in many technical fields for continuous injection of a drug such as insulin or a bioactive substance, microanalysis, a printing device, a small fuel cell, and so on.

Particularly, there are many fields in which a micropump is applied to the human body and used for medical purposes, and research on the micropump is being actively conducted. As a size of a micropump used recently has become miniaturized, a structure of the micropump has been simplified, and a capacity of a battery that supplies energy required to operate the micropump has also reduced.

DOCUMENT OF RELATED ART (Patent Document 1) Korean Patent Application No. 10-2008-0089202 (Korean Patent No. 10-0950926, title of the invention: MICROPUMP WITH A MEMBRANE DRIVEN BY AN ELECTROMAGNET)

SUMMARY OF THE INVENTION

As such, as a size of a micropump is miniaturized, there is an increasing need for a micropump to be designed in a simple structure. In addition, as a capacity of a battery is reduced, there is an increasing need for efficient use of the battery.

Accordingly, the present disclosure has been made keeping in mind the above problems occurring in the related art, and an objective of the present disclosure is to provide a micropump having a simple structure and having a low power consumption.

According to the present disclosure, there is provided a micropump including: a head portion including a first movement guide and a second movement guide that are formed inside the head portion, the head portion including a first tip formed outside the head portion; and a body portion having at least a portion thereof accommodated in the head portion, the body portion including a core, a winding body surrounding the core, a first permanent magnet disposed at a lower end of a second side of the core, a second permanent magnet disposed at a lower end of a first side of the core, a first fixing guide disposed at an upper end of the second side of the core, and a second fixing guide disposed at an upper end of the first side of the core, wherein the first movement guide and the first fixing guide may be formed such that the first movement guide and the first fixing guide correspond to each other, the second movement guide and the second fixing guide may be formed such that the second movement guide and the second fixing guide correspond to each other, the first permanent magnet may be disposed such that a pole thereof faces or opposes a lower end contact surface of the core, and the second permanent magnet may be disposed such that a facing direction of a pole thereof is same as a facing direction of the first permanent magnet.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
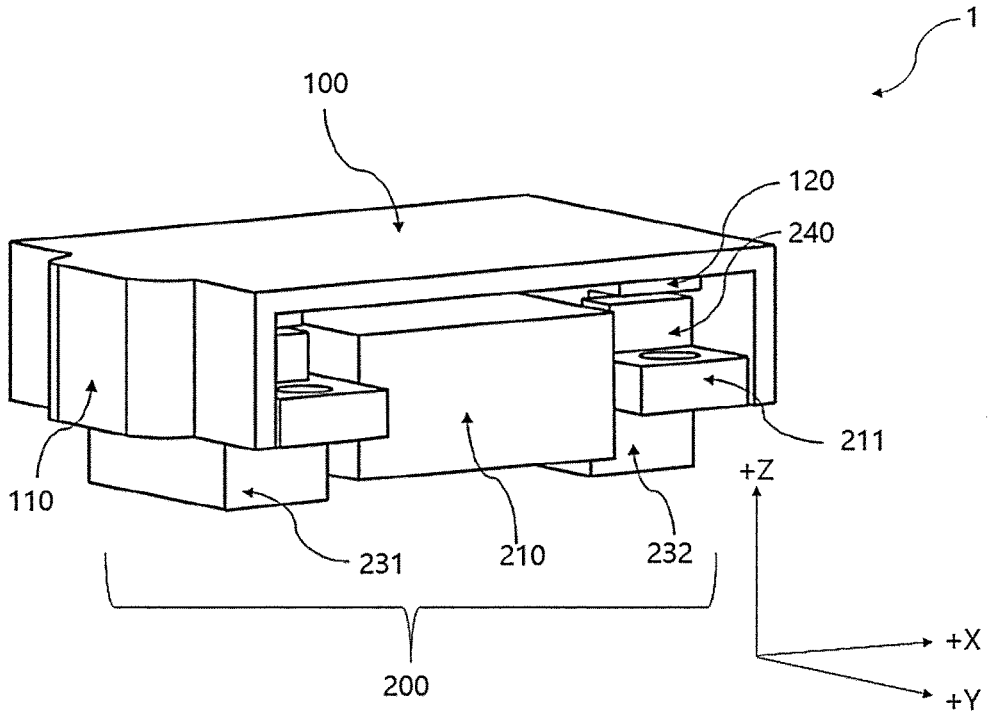
FIG. 1 is a perspective view illustrating a micropump according to various embodiments of the present disclosure.

The present disclosure can have various modifications and various embodiments, and thus, specific embodiments will be illustrated in the drawings and described in detail. However, it should be understood that the specific embodiments according to the concept of the present disclosure are not limited to the embodiments which will be described hereinbelow with reference to the accompanying drawings, but all of modifications, equivalents, and substitutions are included in the scope and spirit of the present disclosure.

In FIGS. 1 to 10, a configuration of a micropump according to various embodiments of the present disclosure is illustrated. Hereinafter, the present disclosure will be described in more detail with reference to the accompanying drawings so as to facilitate understanding of the present disclosure. Following embodiments are provided so as to facilitate understanding of the present disclosure, and the description of the present disclosure is not limited by the following embodiments.

FIG. 1 is a perspective view illustrating a micropump according to various embodiments of the present disclosure.

According to various embodiments, a micropump 1 includes a head portion 100 and a body portion 200.

According to various embodiments, the head portion 100 may be famed in a 'C' shape. A distance between opposite inner side surfaces of the head portion 100 may be similar to or larger than a length (a length in an X-axis direction) of the body portion 200. Accordingly, at least a portion of the body portion 200 may be inserted into an inner portion of the head portion 100. The head portion 100 may be configured to perform a relative movement with respect to the body portion 200. For example, the head portion 100 may be configured to perform a rectilinear movement with respect to a longitudinal direction (for example, the X-axis direction) of the body portion 200. Specifically, the head portion 100 may be configured to perform a reciprocating rectilinear movement to a first side (the +X side) or a second side (the −X side) in the longitudinal direction (the X-axis direction) with respect to the body portion 200.

According to various embodiments, the head portion 100 may include tips 110 formed on opposite ends of the head portion 100 in the longitudinal direction (the X-axis direction). The tips 110 may be formed on the outermost sides of the head portion 100 with respect to the longitudinal direction (the X-axis direction) of the head portion 100.

According to various embodiments, the head portion 100 may include a movement guide 120 formed on an inner side of the head portion 100. The movement guide 120 may be formed such that the movement guide 120 corresponds to a fixing guide 240 of the body portion 200 described later. The movement guide 120 may be disposed such that the movement guide 120 is engaged with the fixing guide 240. Accordingly, the head portion 100 may be guided so that the head portion 100 is moved in the longitudinal direction (the X-axis direction) with respect to the body portion 200.

According to various embodiments, at least a portion of the head portion 100 and at least a portion of a core 211 may be formed of a magnetic metal. As at least the portion of the head portion 100 and at least the portion of the core 211 are formed of the magnetic metal, the head portion 100 may be moved under an influence of an electromagnetic field.

According to various embodiments, the body portion 200 may include a winding body 210, the core 211, a height adjustment portion (for example, height adjustment portions 221 and 222 in FIG. 3A), a permanent magnet 230, and the fixing guide 240.

According to various embodiments, the winding body 210 may be wound around the core 211 and may be disposed in a middle of a longitudinal direction (the X-axis direction) of the micropump 1. The winding body 210 may be electrically connected to a power supply device (not illustrated) and an electric wire (not illustrated). As the winding body 210 receives power from the power supply device (not illustrated), a magnetic field may be generated in the longitudinal direction (the X-axis direction).

According to various embodiments, the height adjustment portion (for example, the height adjustment portions 221 and 222 in FIG. 3A) may be disposed at a lower end portion (for example, the −Z-axis direction) of the permanent magnet 230. The height adjustment portions 221 and 222 may adjust a distance (a height) from the micropump 1 to a support body (for example, a ground) supporting the micropump 1.

According to various embodiments, the permanent magnet 230 may be disposed at each lower end portion (for example, the −Z-axis direction) of each of opposite ends in the longitudinal direction (for example, the X-axis direction) of the core 211. The permanent magnet 230 may be disposed at an upper side direction (for example, the +Z-axis direction) of each of the height adjustment portions 221 and 222 and at a lower side direction (for example, the −Z-axis direction) of the core 211. At least a portion of the permanent magnet 230 and at least a portion of the head portion 100 interact with each other, so that an attraction force may be generated between the permanent magnet 230 and the head portion 100. As the attraction force is generated between the permanent magnet 230 and the head portion 100, a predetermined force may be required so as to separate the head portion 100 from the permanent magnet 230 and to move the head portion 100 to a predetermined direction (the X-axis direction).

According to various embodiments, when the first side (the +X-axis direction) of the head portion 100 is disposed such that the first side (the +X-axis direction) of the head portion 100 is in contact with a first side (the +X-axis direction) surface of the core 211, the head portion 100 may be in a state in which the head portion 100 is moved to the second side (the −X-axis direction) with respect to a center of the body portion 200. When the second side (the −X-axis direction) of the head portion 100 is disposed such that the second side (the −X-axis direction) of the head portion 100 is in contact with a second side (the −X-axis direction) surface of the core 211, the head portion 100 may be in a state in which the head portion 100 is moved to the first side (the +X-axis direction) with respect to the center of the body portion 200.

According to various embodiments, a predetermined force (a force larger than the attraction force between the permanent magnet 230 and the head portion 100) may be required to move the head portion 100 disposed at the second side (the −X-axis direction) with respect to the center of the body portion 200 to the first side (the +X-axis direction). In addition, a predetermined force (a force larger than the attraction force between the permanent magnet 230 and the head portion 100) may be required to move the head portion 100 disposed at the first side (the +X-axis direction) with respect to the center of the body portion 200 to the second side (the −X-axis direction).

According to various embodiments, the fixing guide 240 may be disposed at an upper side (for example, the +Z-axis direction) of the core 211. The fixing guide 240 may be formed such that the fixing guide 240 corresponds to the movement guide 120 of the head portion 100. A description of the movement guide 120 and a description of the fixing guide 240 will be described later along with a description of FIG. 2.

Figure 2:
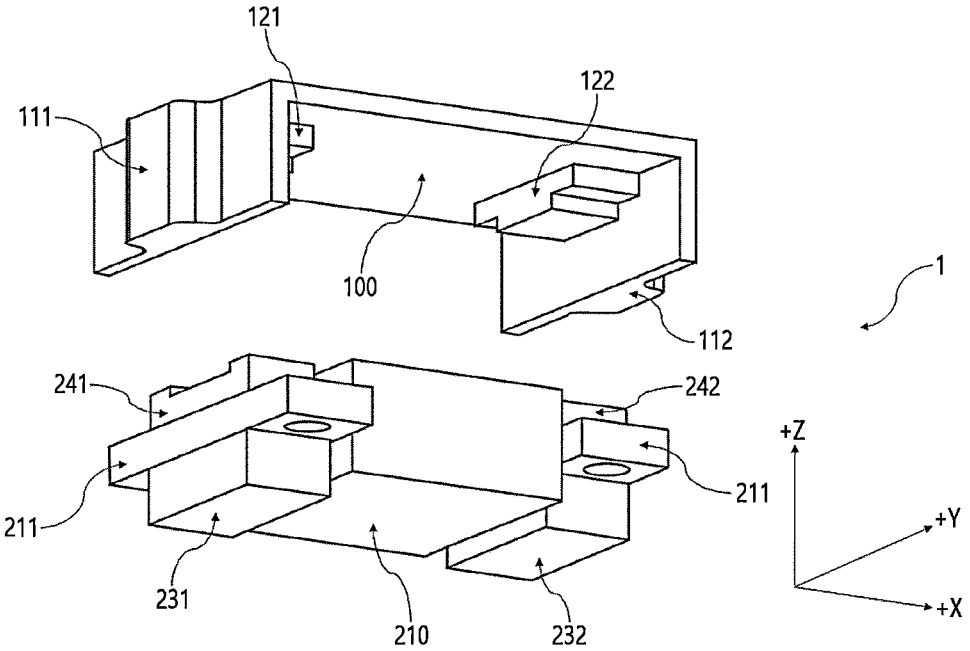
FIG. 2 is an exploded perspective view illustrating the micropump according to various embodiments of the present disclosure.

FIG. 2 is an exploded perspective view illustrating the micropump according to various embodiments of the present disclosure.

The micropump 1, the head portion 100, the body portion 200, and the winding body 210 illustrated in FIG. 2 may be the same or similar to the micropump 1, the head portion 100, the body portion 200, and the winding body 210 illustrated in FIG. 1. Therefore, the description of the same configuration may be omitted.

According to various embodiments, the head portion 100 may include a tip (for example, the tips 110 in FIG. 1) formed on the head portion 100. The tips 110 may include a first tip 111 and a second tip 112. According to an embodiment, the first tip 111 may be formed on the second side (the −X-axis direction) in the longitudinal direction of the head portion 100, and the second tip 112 may be formed on the first side (the +X-axis direction) in the longitudinal direction of the head portion 100.

According to various embodiments, the head portion 100 may include a movement guide (for example, the movement guide 120 in FIG. 1) formed on the head portion 100. The movement guide 120 may include a first movement guide 121 and a second movement guide 122. convex portions may be respectively formed on the first movement guide 121 and the second movement guide 122.

According to various embodiments, the body portion 200 may include a fixing guide (for example, the fixing guide 240 in FIG. 1) disposed at the body portion 200. The fixing guide 240 may include a first fixing guide 241 and a second fixing guide 242. concave portions may be respectively formed on the first fixing guide 241 and the second fixing guide 242.

According to various embodiments, the convex portions of the first movement guide 121 and the second movement guide 122 and the concave portions of the first fixing guide 241 and the second fixing guide 242 may be formed so as to correspond to each other, and may be formed along the longitudinal direction (the X-axis direction) of the micropump 1.

According to various embodiments, concave portions may be respectively formed on the first movement guide 121 and the second movement guide 122, and convex portions may be formed on the first fixing guide 241 and the second fixing guide 242. The concave portions of the first movement guide 121 and the second movement guide 122 and the convex portions of the first fixing guide 241 and the second fixing guide 242 may be formed so as to correspond to each other, and may be formed along the longitudinal direction (the X-axis direction) of the micropump 1.

According to various embodiments, the body portion 200 may include a height adjustment portion (for example, the height adjustment portions 221 and 222 in FIG. 3A) disposed at the body portion 200. The height adjustment portion may include a first height adjustment portion 221 and a second height adjustment portion 222. The first height adjustment portion 221 and the second height adjustment portion 222 may adjust a distance from the body portion 200 to a ground surface (not illustrated) supporting the body portion 200.

According to various embodiments, the body portion 200 may include a permanent magnet (for example, the permanent magnet 230 in FIG. 1) disposed at the body portion 200. The permanent magnet 230 may include a first permanent magnet 231 and a second permanent magnet 232. The first permanent magnet 231 may be disposed at a lower end (the −Z-axis direction) of the second side (the −X-axis direction) of the core 211, and the second permanent magnet 232 may be disposed at a lower end (the −Z-axis direction) of the first side (the +X-axis direction) of the core 211. The core 211 may be disposed such that the core 211 is in contact with the head portion 100. The second side (the −X-axis direction) of the core 211 may be in contact with at least a portion of the second side (the −X-axis direction) of the head portion 100, and an attraction force may be generated between the second side of the core 211 and at least a portion of the head portion 100 by an electromagnetic force. The first side (the +X-axis direction) of the core 211 may be in contact with at least a portion of the first side (the +X-axis direction) of the head portion 100, and an attraction force may be generated between the first side of the core 211 and at least a portion of the head portion 100 by an electromagnetic force.

Figure 3A:
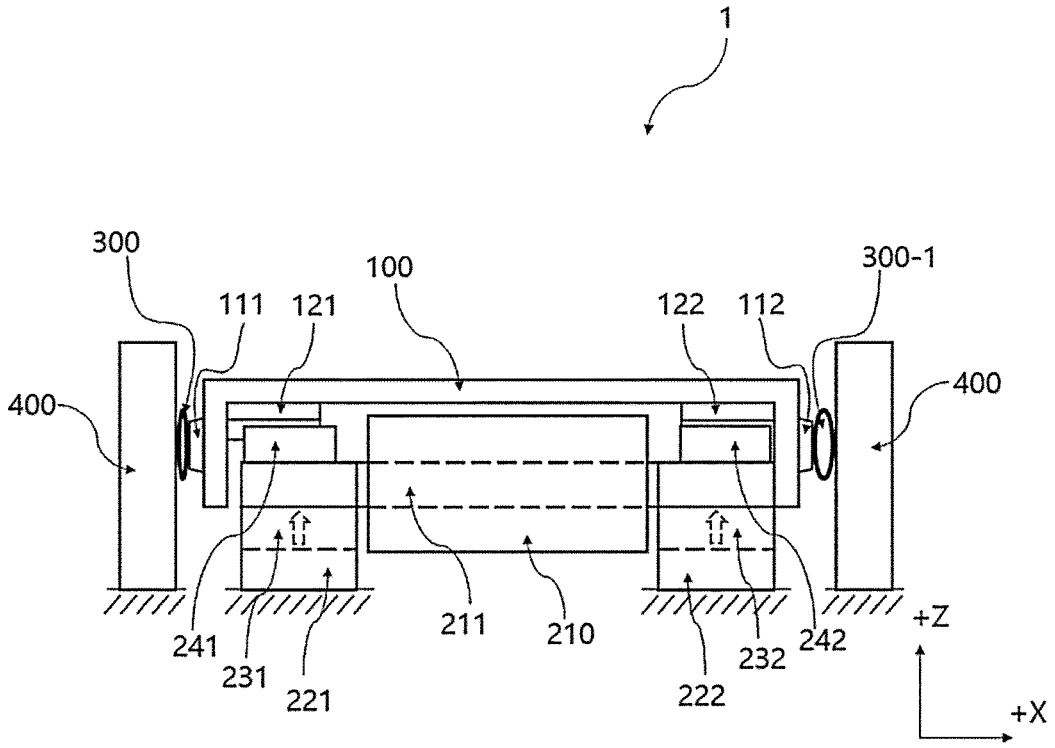
FIG. 3A is a front view illustrating the micropump according to various embodiments of the present disclosure.
Figure 3B:
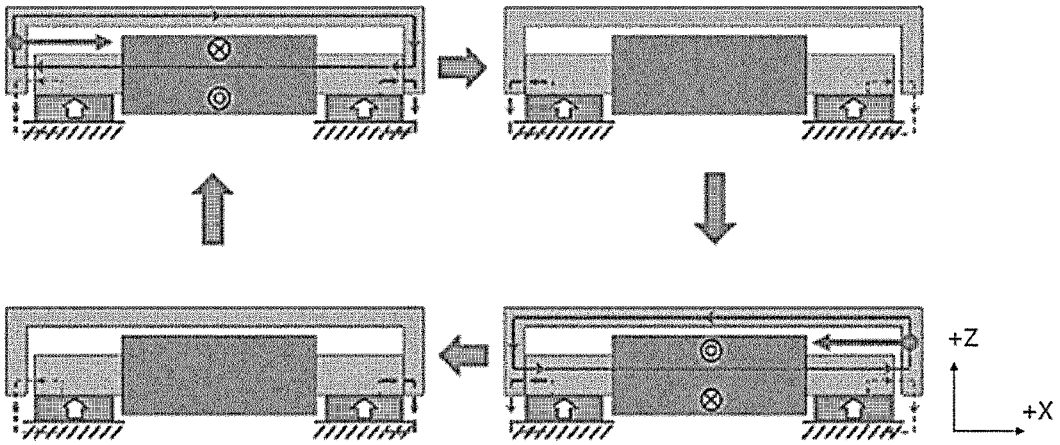
FIG. 3B is a front view of the micropump in various states according to various embodiments of the present disclosure.

FIG. 3A is a front view illustrating the micropump according to various embodiments of the present disclosure, and FIG. 3B is a front view of the micropump in various states according to various embodiments of the present disclosure.

The micropump 1, the head portion 100, the first tip 111, the second tip 112, the first movement guide 121, the second movement guide 122, the body portion 200, the winding body 210, the first height adjustment portion 221, the second height adjustment portion 222, the first permanent magnet 231, the second permanent magnet 232, the first fixing guide 241, and the second fixing guide 242 that are illustrated in FIGS. 3A and 3B may be the same or similar to the micropump 1, the head portion 100, the first tip 111, the second tip 112, the first movement guide 121, the second movement guide 122, the body portion 200, the winding body 210, the first height adjustment portion 221, the second height adjustment portion 222, the first permanent magnet 231, the second permanent magnet 232, the first fixing guide 241, and the second fixing guide 242 that are illustrated in FIGS. 1 and 2. Therefore, the description of the same configuration may be omitted.

According to various embodiments, the micropump 1 may further include the core 211. The core 211 may be disposed such that the core 211 is surrounded by the winding body 210. As the core 211 is disposed such that the core 211 is surrounded by the winding body 210, a strength of an electromagnetic field generated in the winding body 210 may increase.

According to various embodiments, a tube 300 in contact with the first tip 111 and the second tip 112 of the micropump 1 may be disposed. The tube 300 may be disposed between the first tip 111 and a support member 400, or may be disposed between the second tip 112 and the support member 400. According to a movement of the head portion 100 with respect to the longitudinal direction (the X-axis direction) of the micropump 1, a size of an inner diameter of the tube 300 may change. As the size of the inner diameter of the tube 300 changes, fluid inside the tube 300 may flow or may not flow.

Referring to FIGS. 3A and 3B, according to various embodiments, when electric current is applied in a first direction and an electromagnetic field generated in the winding body 210 acts on the head portion 100 and then the head portion 100 is moved in the −X-axis direction, the first side (the +X-axis direction) of the core 211 and at least a portion of the head portion 100 are in contact with each other, the first tip 111 is in contact with the tube 300 disposed at the −X-axis direction, and the inner diameter of the tube 300 between the first tip 111 and the support body 400 is decreased, so that fluid may not flow. The inner diameter of tube 300 disposed at the +X-axis direction is increased, so that fluid may flow.

According to various embodiments, when electric current is applied in a second direction that is a direction opposite to the first direction and an electromagnetic field generated in the winding body 210 acts on the head portion 100 and then the head portion 100 is moved in the +X-axis direction, the second side (the −X-axis direction) of the core 211 and at least a portion of the head portion 100 are in contact with each other, the second tip 112 is in contact with the tube 300 disposed at the +X-axis direction, and the inner diameter of the tube 300 between the second tip 112 and the support body 400 is decreased, so that fluid may not flow. The inner diameter of tube 300 disposed at the −X-axis direction is increased, so that fluid may flow.

According to various embodiments, a direction of an attraction force acting between the second side (the −X-axis direction) of the core 211 and the head portion 100 and a direction of an attraction force acting between the first side (the +X-axis direction) of the core 211 and the head portion 100 are opposite to each other.

Terms describing attraction forces F1*c*, F1*u*, F2*c*, and F2*u* used hereafter will be described. The attraction force F1*c* is an attraction force that occurs when the second side (the −X-axis direction) of the core 211 is in contact with the head portion 100, and the attraction force F2*u* is an attraction force that occurs when the first side (the +X-axis direction) of the core 211 is not in contact with the head portion 100.

The attraction force F2*c* is an attraction force that occurs when the first side (the +X-axis direction) of the core 211 is in contact with the head portion 100, and the attraction force F1*u* is an attraction force that occurs when the second side (the −X-axis direction) of the core 211 is not in contact with the head portion 100.

According to various embodiments, when the second side (the −X-axis direction) of the core 211 and the head portion 100 are in contact with each other, a magnitude of the attraction force F1*c* between the second side (the −X-axis direction) of the core 211 and the head portion 100 may be larger than a magnitude of the attraction force F2*u* between the first side (the +X-axis direction) of the core 211 and the head portion 100.

According to various embodiments, when the first side (the +X-axis direction) of the core 211 and the head portion 100 are in contact with each other, a magnitude of the attraction force F2*c* between the first side (the +X-axis direction) of the core 211 and the head portion 100 may be larger than a magnitude of the attraction force F1*u* between the second side (the −X-axis direction) of the core 211 and the head portion 100.

Therefore, when the second side (the −X-axis direction) of the core 211 is in contact with the head portion 100, a force larger than a difference between the attraction force F1*c* between the second side (the −X-axis direction) of the core 211 and the head portion 100 and the attraction force F2*u* between the first side (the +X-axis direction) of the core 211 and the head portion 100 is required to be generated in the winding body 210 in order to bring the head portion 100 into contact with the first side (the +X-axis direction) of the core 211. In addition, when the first side (the +X-axis direction) of the core 211 is in contact with the head portion 100, a force larger than a difference between the attraction force F2*c* between the first side (the +X-axis direction) of the core 211 and the head portion 100 and the attraction force F1*u* between the second side (the −X-axis direction) of the core 211 and the head portion 100 is required to be generated in the winding body 210 in order to bring the head portion 100 into contact with the second side (the −X-axis direction) of the core 211.

As such, as the first permanent magnet 231, the second permanent magnet 232, the core 211, and the winding body 210 are used, the head portion 100 may be moved in a specific direction by applying only instantaneous electric current to the winding body 210. As only the instantaneous electric current is applied, power required to move the head portion 100 may be very small. The description of the power consumed in the winding body 210 will be described later along with the description of FIG. 10. According to various embodiments, the tube 300 may be formed of an elastic material. As the inner diameter of the tube 300 changes, an elastic force of the tube 300 may be applied to the first tip 111 and/or the second tip 112. The micropump 1 may be designed in consideration of the elastic force of the tube 300, the attraction force between the permanent magnet 230 and the head portion 100, and the electromagnetic force generated in the winding body 210.

Figure 4A:
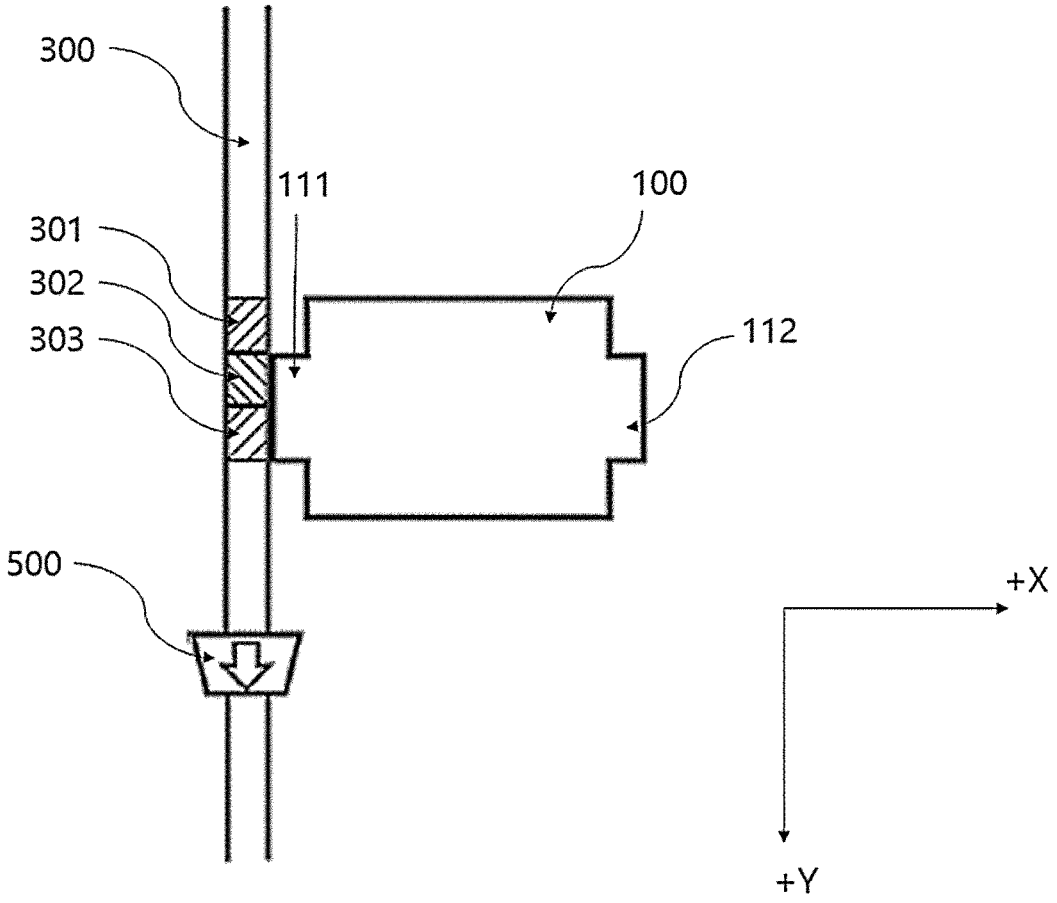
FIGS. 4A to 4C are plan views illustrating an operation of the micropump according to various embodiments of the present disclosure.
Figure 4B:
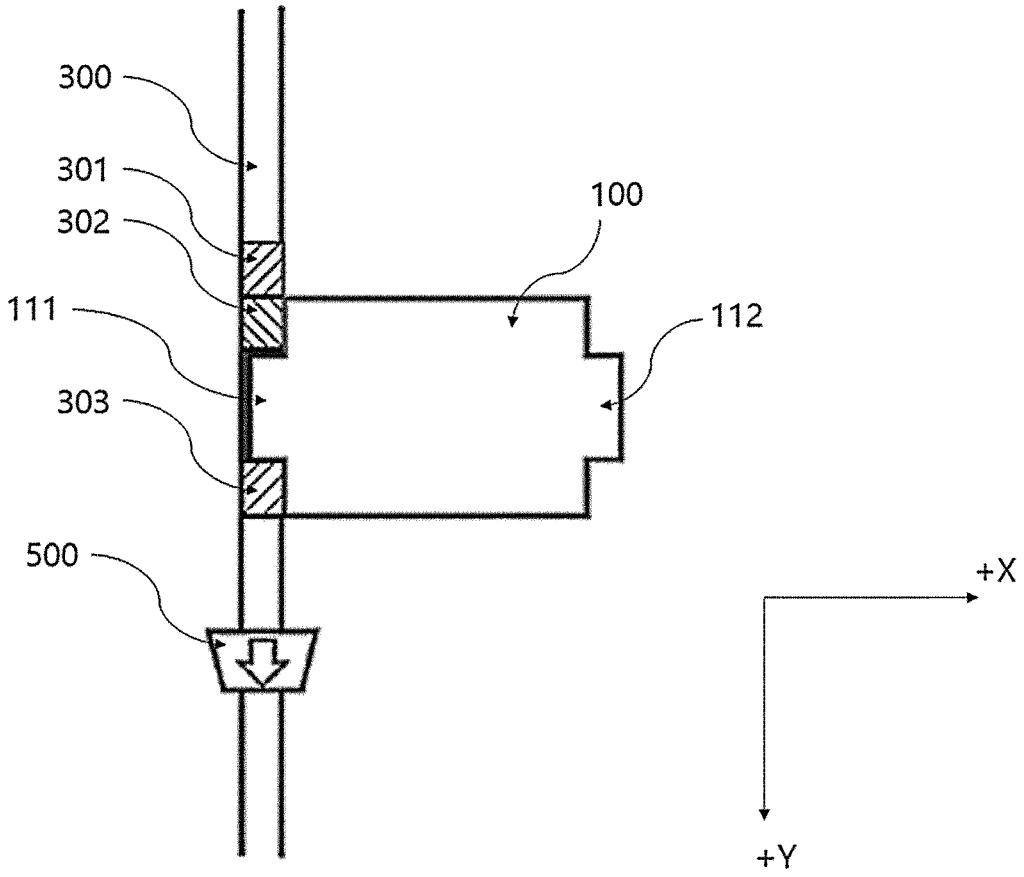
Figure 4C:
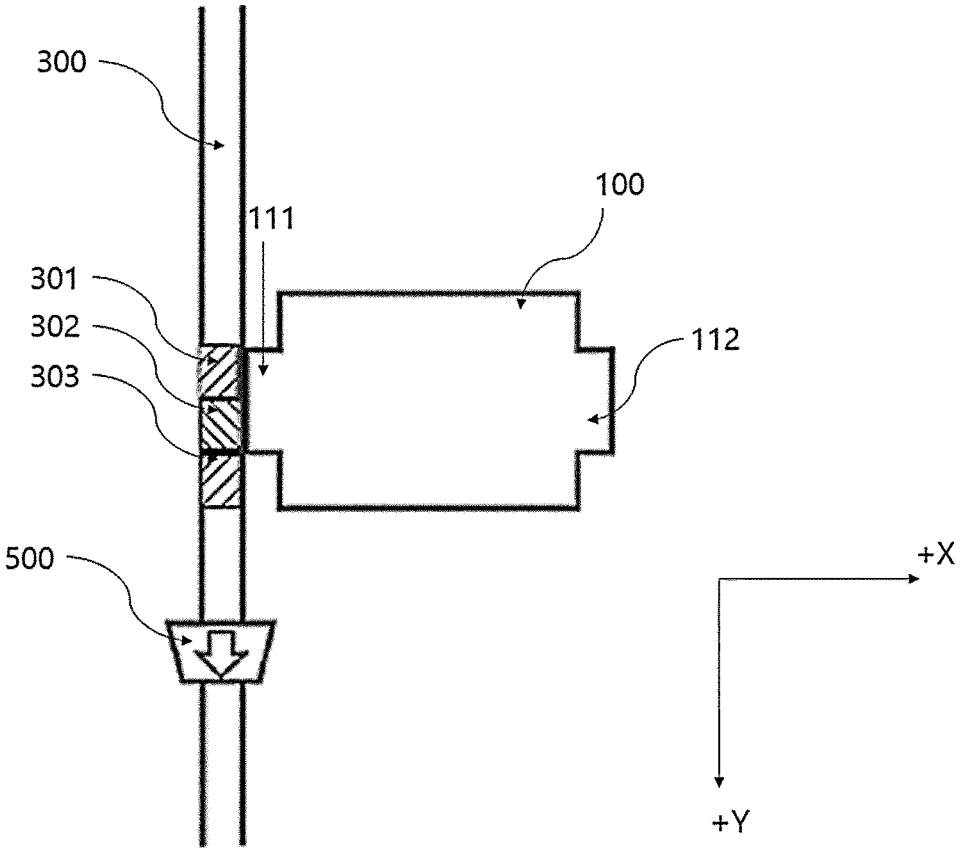

FIGS. 4A to 4C are plan views illustrating an operation of the micropump according to various embodiments of the present disclosure.

The head portion 100, the first tip 111, the second tip 112, and the tube 300 that are illustrated in FIGS. 4A to 4C may be the same or similar to the head portion 100, the first tip 111, the second tip 112, and the tube 300 illustrated in FIGS. 1 to 3B. Therefore, the description of the same configuration may be omitted.

Referring to FIGS. 4A to 4C, according to various embodiments, the tube 300 may be disposed such that the tube 300 is in contact with the first tip 111. The tube 300 may contain fluids 301, 302, and 303. A check valve 500 is disposed on the tube 300, so that fluids 301, 302, and 303 may flow only in one direction. For convenience of the description, the fluids are divided into a first fluid 301, a second fluid 302, and a third fluid 303. The first fluid 301, the second fluid 302, and the third fluid 303 may be sequentially disposed in a +Y axis direction.

Referring to FIG. 4A, the first tip 111 is disposed such that the inner diameter of at least a portion of the tube 300 does not decrease. The second fluid 302 and the third fluid 303 may be disposed adjacent to the first tip 111.

Referring to FIG. 4A, the first tip 111 may be disposed such that an inner diameter of at least a portion of the tube 300 is decreased. For example, the first tip 111 may be moved in the −X-axis direction. As the first tip 111 is disposed such that the inner diameter of at least a portion of the tube 300 is decreased, a volume of the tube 300 is reduced, so that the third fluid 303 may be moved in the +Y-axis direction. As the third fluid 303 moves, the third fluid 303 may be disposed in the +Y-axis direction than the first tip 111.

Referring to FIG. 4C, as the first tip 111 is moved in the +X-axis direction, the inner diameter of at least a portion of the tube 300 may increase. As the inner diameter of the tube 300 increases, the first fluid 301 and the second fluid 302 may be moved in the +Y-axis direction.

According to various embodiments, the check valve 500 may be configured to control fluid so that the fluid flows only in one direction (for example, the +Y-axis direction).

As a series of processes illustrated in FIGS. 4A to 4C is repeated, the fluids 301, 302, and 303 may be moved in a specific direction (the +Y-axis direction).

Figure 5:
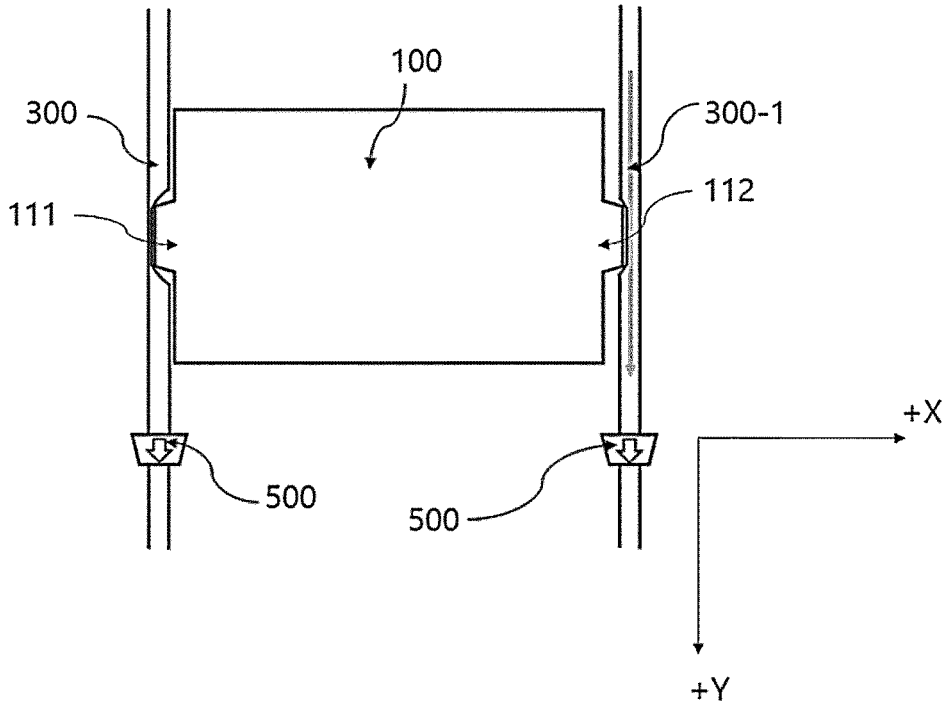
FIG. 5 is a plan view illustrating the micropump according to various embodiments of the present disclosure.

FIG. 5 is a plan view illustrating the micropump according to various embodiments of the present disclosure.

The head portion 100, the first tip 111, the second tip 112, the tube 300, and the check valve 500 that are illustrated in FIG. 5 may be the same or similar to the head portion 100, the first tip 111, the second tip 112, the tube 300, and the check valve 500 that are illustrated in FIGS. 1 to 4C. Therefore, the description of the same configuration may be omitted.

In the configuration of the micropump 1 illustrated in FIG. 5, the tube 300 capable of being in contact with the second tip 112 in the configuration of the micropump 1 illustrated in FIGS. 4A to 4C is added. As the tube 300 that is capable of being in contact with the second tip 112 is added, the micropump 1 may control a movement of fluid with respect to the two tubes 300.

Figure 6A:
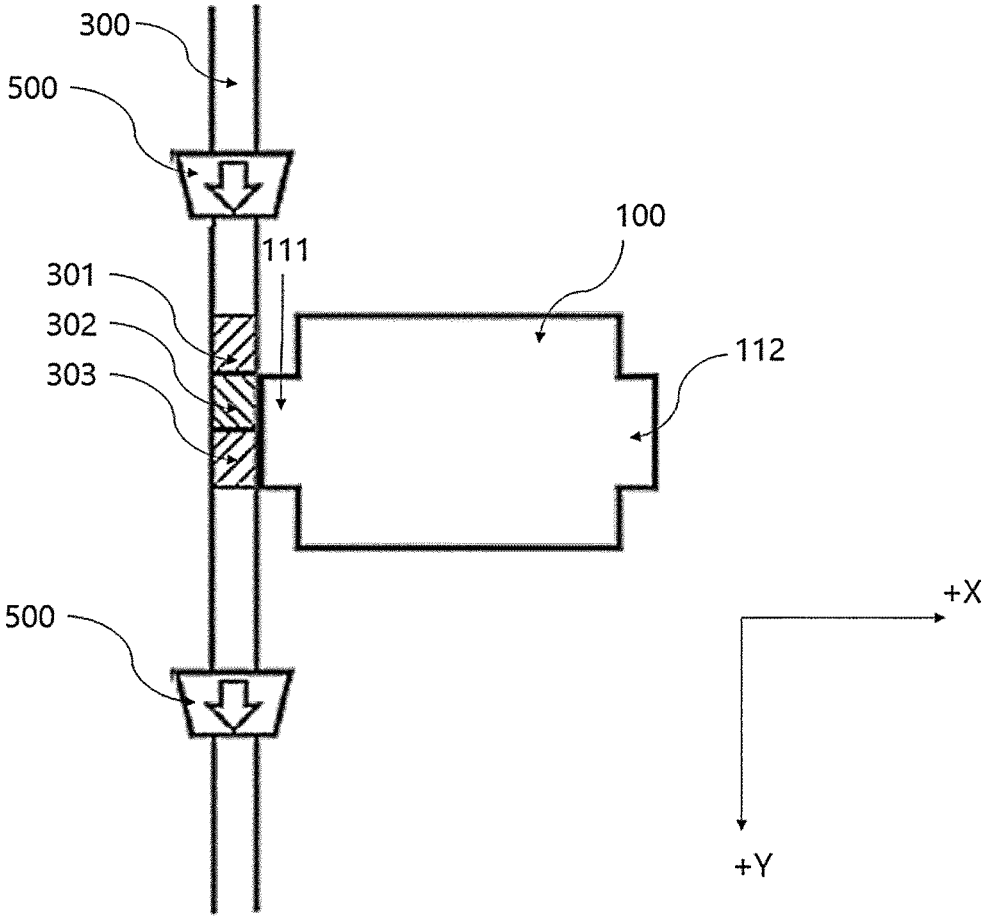
FIGS. 6A to 6C are plan views illustrating an operation of the micropump according to various embodiments of the present disclosure.
Figure 6B:
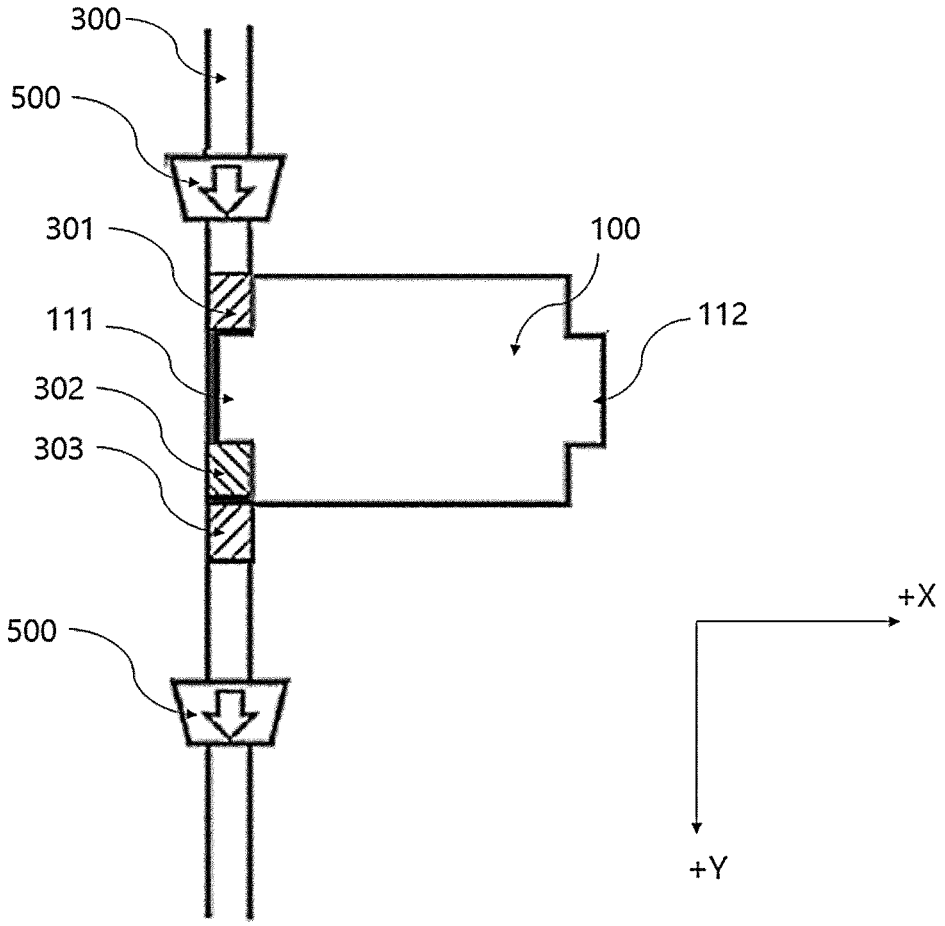
Figure 6C:
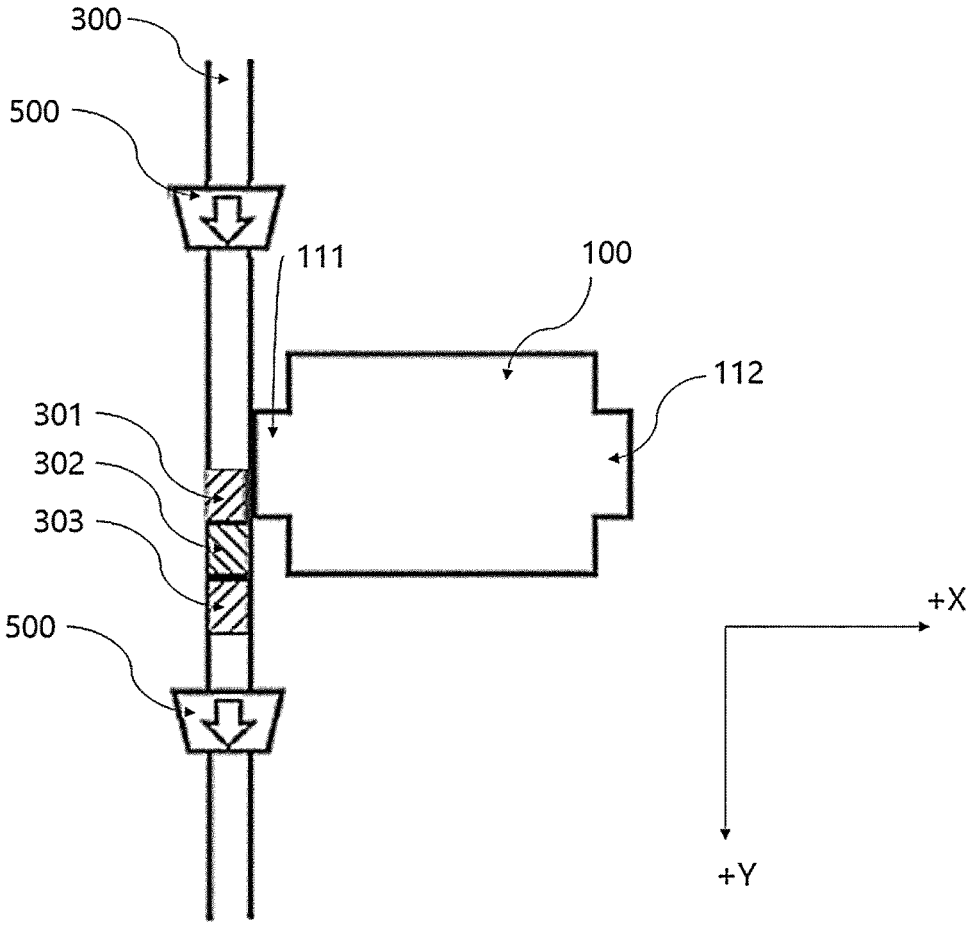

FIGS. 6A to 6C are plan views illustrating an operation of the micropump according to various embodiments of the present disclosure.

The head portion 100, the first tip 111, the second tip 112, the tube 300, the first fluid 301, the second fluid 302, the third fluid 303, and the check valve 500 that are illustrated in FIGS. 6A to 6C may be the same or similar to the head portion 100, the first tip 111, the second tip 112, the tube 300, the first fluid 301, the second fluid 302, the third fluid 303, and the check valve 500 that are illustrated in FIGS. 1 to 5. Therefore, the description of the same configuration may be omitted.

In the configuration illustrated in FIGS. 6A to 6C, the check valve 500 is added to the −Y-axis direction of the tube 300 in the configuration illustrated in FIGS. 4A to 4C.

According to various embodiments, the check valves 500 may be respectively disposed on the first side and the second side of the tube 300, and the first tip 111 and/or the second tip 112 may be configured to press at least a portion of the tube 300 between the check valves 500. As the first tip 111 and/or the second tip 112 presses at least a portion of the tube 300 and the inner diameter of the tube 300 is decreased, the fluids 301, 302, and 303 are capable of being moved. As the two check valves 500 are disposed on the tube 300 and the inner diameter of the tube 300 between the two check valves 500 is decreased, the fluids 301, 302, and 303 may be moved only in one direction (the +Y-axis direction).

Referring to FIG. 6A, the first tip 111 is disposed such that the inner diameter of at least a portion of the tube 300 does not decrease. The second fluid 302 and the third fluid 303 may be disposed adjacent to the first tip 111.

Referring to FIG. 6B, the first tip 111 may be disposed such that the inner diameter of at least a portion of the tube 300 is decreased. For example, the first tip 111 may be moved in the −X-axis direction. As the first tip 111 is disposed such that the inner diameter of at least a portion of the tube 300 is decreased, a volume of the tube 300 is reduced, so that the second fluid 302 and the third fluid 303 may be moved in the +Y-axis direction. As the second fluid 302 and the third fluid 303 move, the second fluid 302 and the third fluid 303 may be more disposed in the +Y axis direction than the first tip 111. As the two check valves 500 are disposed, the fluids 301, 302, and 303 may be moved only in the +Y-axis direction. For example, the fluids 301, 302, and 303 cannot pass through the check valve 500 disposed on the −Y-axis direction and cannot be moved in the −Y-axis direction. Fluid more disposed in the +Y-axis direction than the check valve 500 that is disposed in the +Y-axis direction cannot be moved in the −Y-axis direction.

Referring to FIG. 6C, as the first tip 111 is moved in the +X-axis direction, the inner diameter of at least a portion of the tube 300 may increase. As the inner diameter of the tube 300 increases, the first fluid 301 may be moved in the +Y-axis direction. As the two check valves 500 are disposed, the fluids 301, 302, and 303 may be moved only in the +Y-axis direction. For example, the fluids 301, 302, and 303 cannot be moved in the −Y-axis direction after the fluids 301, 302, and 303 move in the +Y-axis direction and pass through the check valve 500 disposed on the −Y-axis direction. Fluid more disposed in the +Y-axis direction than the check valve 500 that is disposed in the +Y-axis direction cannot be moved in the −Y-axis direction.

Figure 7:
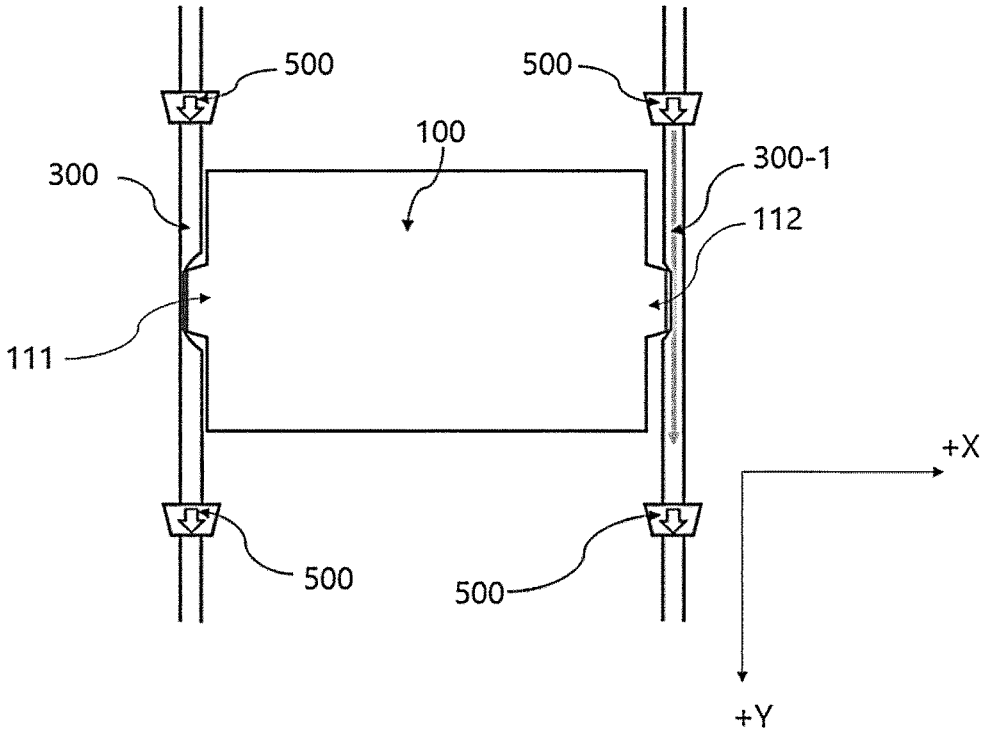
FIG. 7 is a plan view illustrating the micropump according to various embodiments of the present disclosure.

FIG. 7 is a plan view illustrating the micropump according to various embodiments of the present disclosure.

The head portion 100, the first tip 111, the second tip 112, the tube 300, and the check valve 500 that are illustrated in FIG. 7 may be the same or similar to the head portion 100, the first tip 111, the second tip 112, the tube 300, and the check valve 500 that are illustrated in FIGS. 1 to 6C. Therefore, the description of the same configuration may be omitted.

In the configuration of the micropump 1 illustrated in FIG. 7, the tube 300 capable of being in contact with the second tip 112 in the configuration of the micropump 1 illustrated in FIGS. 6A to 6C is added. As the tube 300 that is capable of being in contact with the second tip 112 is added, the micropump 1 may control a movement of fluid with respect to the two tubes 300.

Figure 8A:
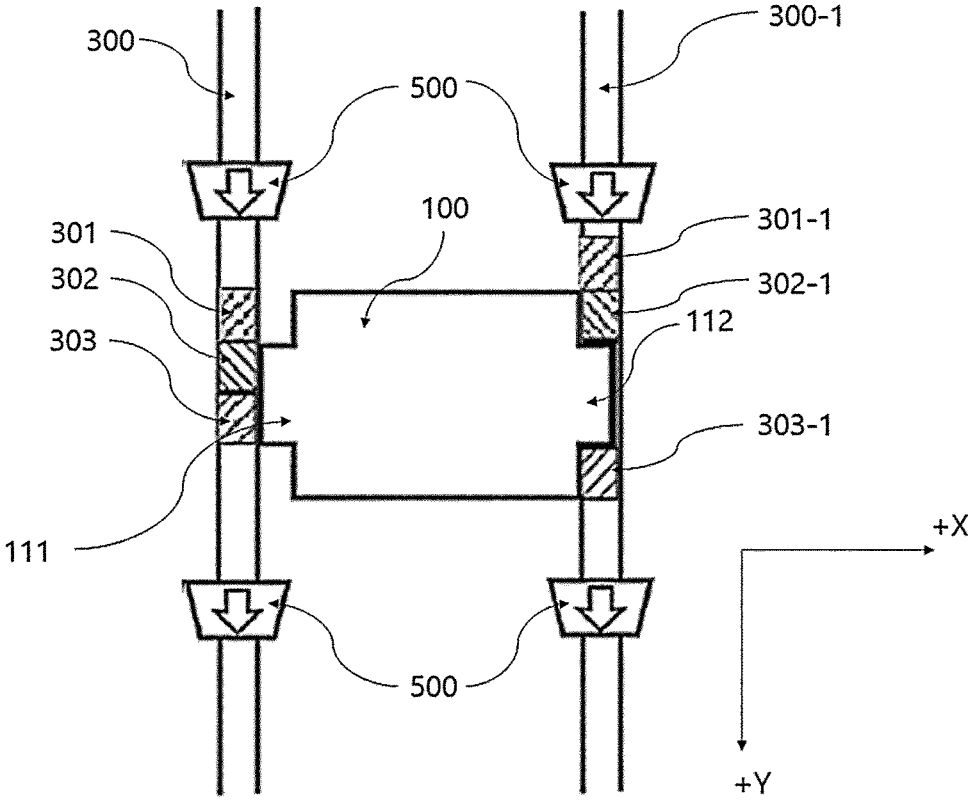
FIGS. 8A to 8C are plan views illustrating an operation of the micropump according to various embodiments of the present disclosure.
Figure 8B:
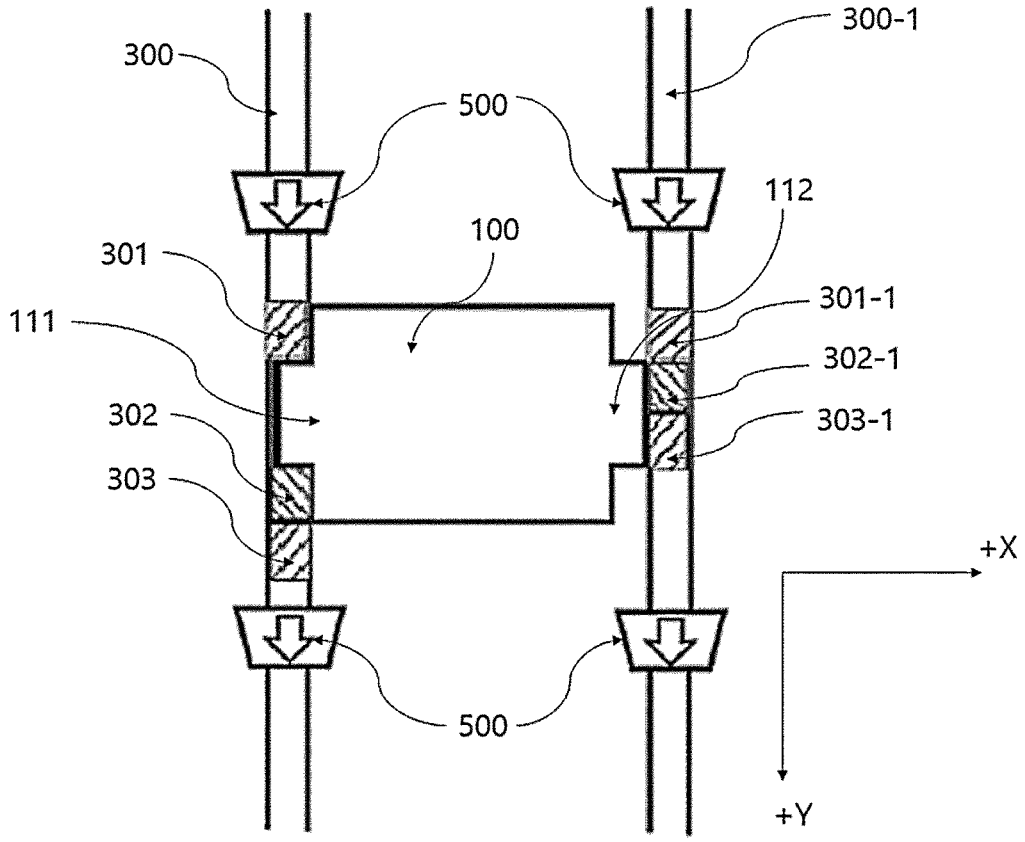
Figure 8C:
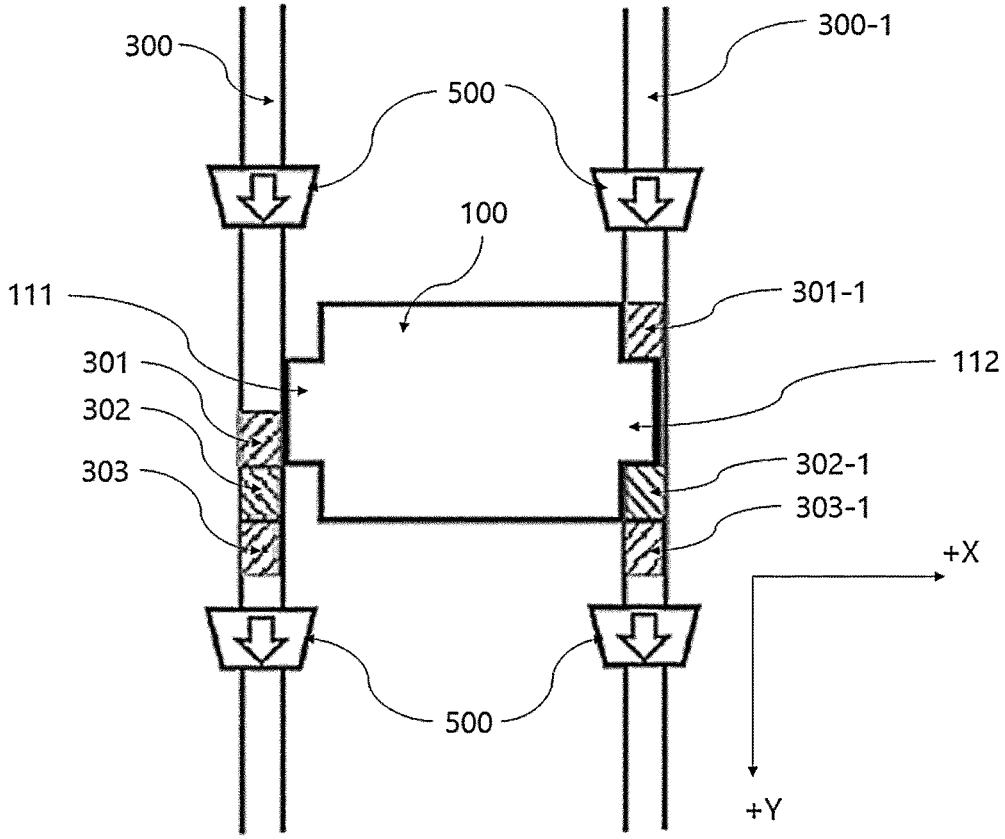

FIGS. 8A to 8C are plan views illustrating an operation of the micropump according to various embodiments of the present disclosure.

The head portion 100, the first tip 111, the second tip 112, the tube, the first fluid 301, the second fluid 302, the third fluid 303, and the check valve 500 that are illustrated in FIGS. 8A to 8C may be the same or similar to the head portion 100, the first tip 111, the second tip 112, the tube, the first fluid 301, the second fluid 302, the third fluid 303, and the check valve 500 that are illustrated in FIGS. 1 to 7. Therefore, the description of the same configuration may be omitted.

According to various embodiments, FIGS. 8A to 8C illustrate a process in which fluids 301, 301-1, 302, 302-1, 303, and 303-1 are moved by the micropump 1 in the configuration illustrated in FIG. 7.

Referring to FIG. 8A, according to various embodiments, the head portion 100 may be disposed such that the head portion 100 is in contact with a tube 300-1 that is disposed at the +X-axis direction of the head portion 100.

Referring to FIG. 8B, the head portion 100 may be moved in the −X-axis direction so that the first tip 111 reduces the inner diameter of at least a portion of the tube 300 disposed at the −X-axis direction of the head portion 100. As the first tip 111 is disposed such that the inner diameter of at least a portion of the tube 300 is decreased, a volume of the tube 300 is reduced, so that the second fluid 302 and the third fluid 303 may be moved in the +Y-axis direction and the 1-1 fluid 301-1 and the 2-1 fluid 302-1 may be moved in the +Y-axis direction. The second fluid 302 and the third fluid 303 may be more disposed in the +Y-axis direction than the first tip 111. As the two check valves 500 are disposed, the fluids 301, 302, and 303 may be moved only in the +Y-axis direction. For example, the fluids 301, 302, and 303 cannot pass through the check valve 500 disposed on the −Y-axis direction and cannot be moved in the −Y-axis direction. Fluid more disposed in the +Y-axis direction than the check valve 500 that is disposed in the +Y-axis direction cannot be moved in the −Y-axis direction.

Referring to FIG. 8C, as the first tip 111 is moved in the +X-axis direction, the inner diameter of at least a portion of the tube 300 may increase. As the inner diameter of the tube 300 increases, the first fluid 301 and/or the second fluid 302 may be moved in the +Y-axis direction. As the second tip 112 is moved in the +X-axis direction, the inner diameter of at least a portion of the tube 300-1 may decrease. As the inner diameter of the tube 300 decreases, the 2-1 fluid 302-1 and the 3-1 fluid 303-1 may be moved in the +Y-axis direction.

As the two check valves 500 are disposed, the fluids 301, 301-1, 302, 302-1, 303, and 303-1 may be moved only in the +Y-axis direction. For example, the fluids 301, 301-1, 302, 302-1, 303, and 303-1 cannot be moved in the −Y-axis direction after the fluids 301, 301-1, 302, 302-1, 303, and 303-1 move in the +Y-axis direction and pass through the check valve 500 disposed on the −Y-axis direction. Fluid more disposed in the +Y-axis direction than the check valve 500 that is disposed in the +Y-axis direction cannot be moved in the −Y-axis direction.

Figure 9A:
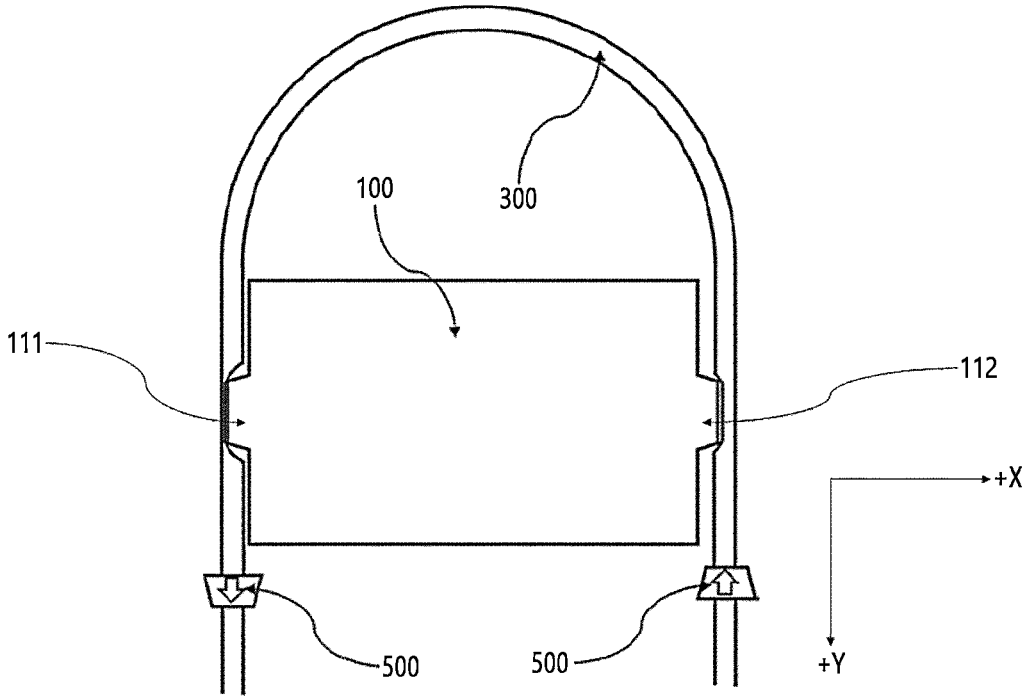
FIGS. 9A to 9C are plan views illustrating an operation of the micropump according to various embodiments of the present disclosure.
Figure 9B:
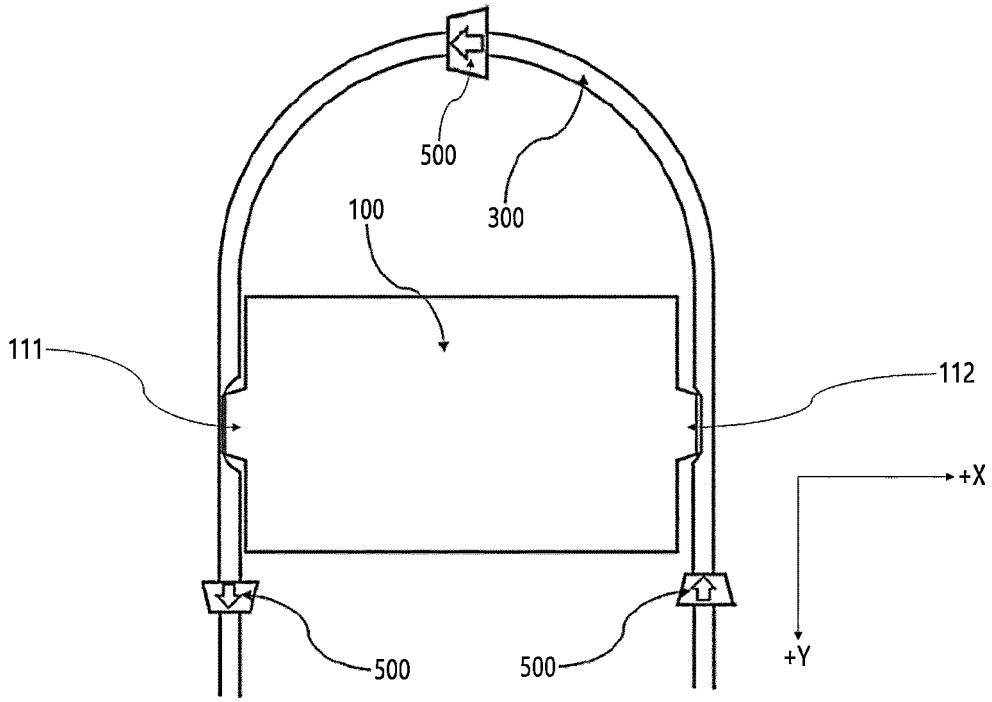
Figure 9C:
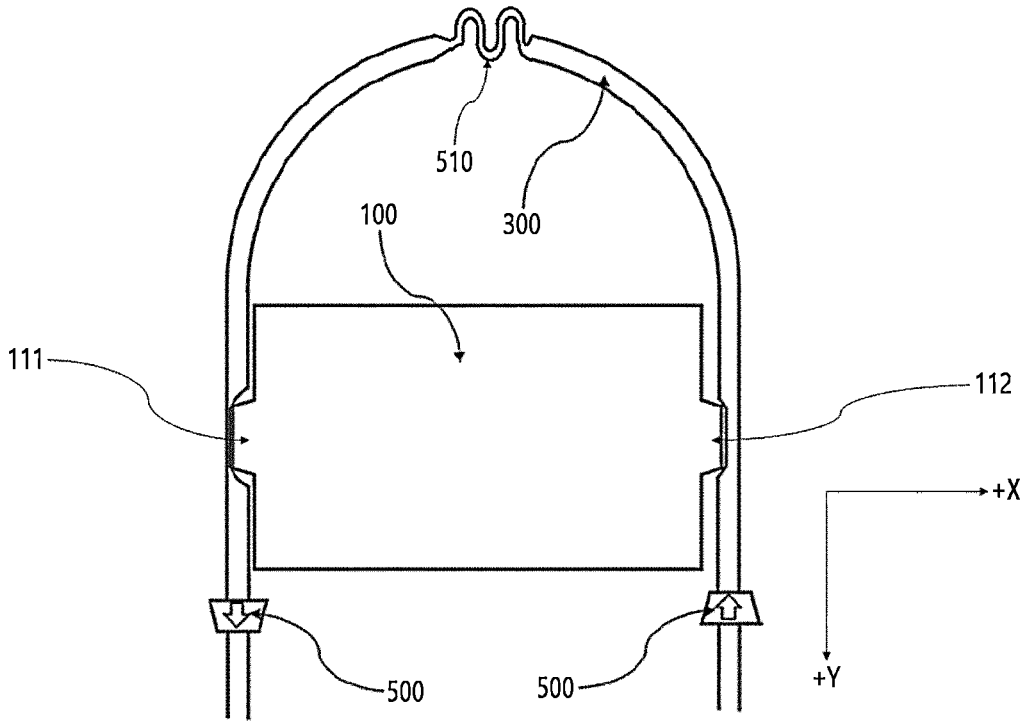

FIGS. 9A to 9C are plan views illustrating an operation of the micropump according to various embodiments of the present disclosure.

The head portion 100, the first tip 111, the second tip 112, the tube 300, and the check valve 500 that are illustrated in FIGS. 9A to 9C may be the same or similar to the head portion 100, the first tip 111, the second tip 112, the tube 300, and the check valve 500 that are illustrated in FIGS. 1 to 8C. Therefore, the description of the same configuration may be omitted.

Referring to FIGS. 9A to 9C, according to various embodiments, the tubes 300 respectively disposed at the opposite ends in the longitudinal direction (the X-axis direction) of the head portion 100 may be connected to each other. For example, the tubes 300 may be configured such that the tubes 300 are connected to each other in the −Y-axis direction of the head portion 100. Fluid in the tube 300 in the +X-axis direction of the head portion 100 may be moved toward the −Y-axis direction, and fluid in the tube 300 in the −X-axis direction of the head portion 100 may be moved toward the +Y-axis direction. According to the configuration described above, it can be seen that the tube 300 disposed in the +Y-axis direction of the second tip 112 is upstream and a position toward the first tip 111 is downstream on the basis of the flow of the fluid. The check valve 500 disposed adjacent to the second tip 112 may be configured to move the fluid disposed in the tube 300 only to the −Y-axis direction, and the check valve 500 disposed adjacent to the first tip 111 may be configured to move the fluid disposed in the tube 300 only to the +Y-axis direction.

Referring to FIG. 9B, according to various embodiments, in the configuration illustrated in FIG. 9B, the check valve 500 may be additionally disposed in the configuration illustrated in FIG. 9A. The additional check valve 500 may be disposed between the check valve 500 on the upstream side and the check valve 500 on the downstream side. For example, the additional check valve 500 may be disposed in the −Y-axis direction of the head portion 100. Specifically, the additional check valve 500 may be disposed on at least a portion of the tube 300 between the first tip 111 and the second tip 112. As the additional check valve 500 is disposed on the tube 300, the fluid in the tube 300 may be prevented from moving from the downstream to the upstream.

Referring to FIG. 9C, according to various embodiments, in the configuration illustrated in FIG. 9C, the additional check valve 500 in the configuration illustrated in FIG. 9B is replaced with a capillary tube 510. The capillary tube 510 is a tube having a diameter thinner than a diameter of the tube 300, and is capable of generating resistance to the flow of the fluid. As resistance is generated to the flow of the fluid, the capillary tube 510 may adjust a flow rate of the fluid moving from the downstream side to the upstream side.

Figure 10:
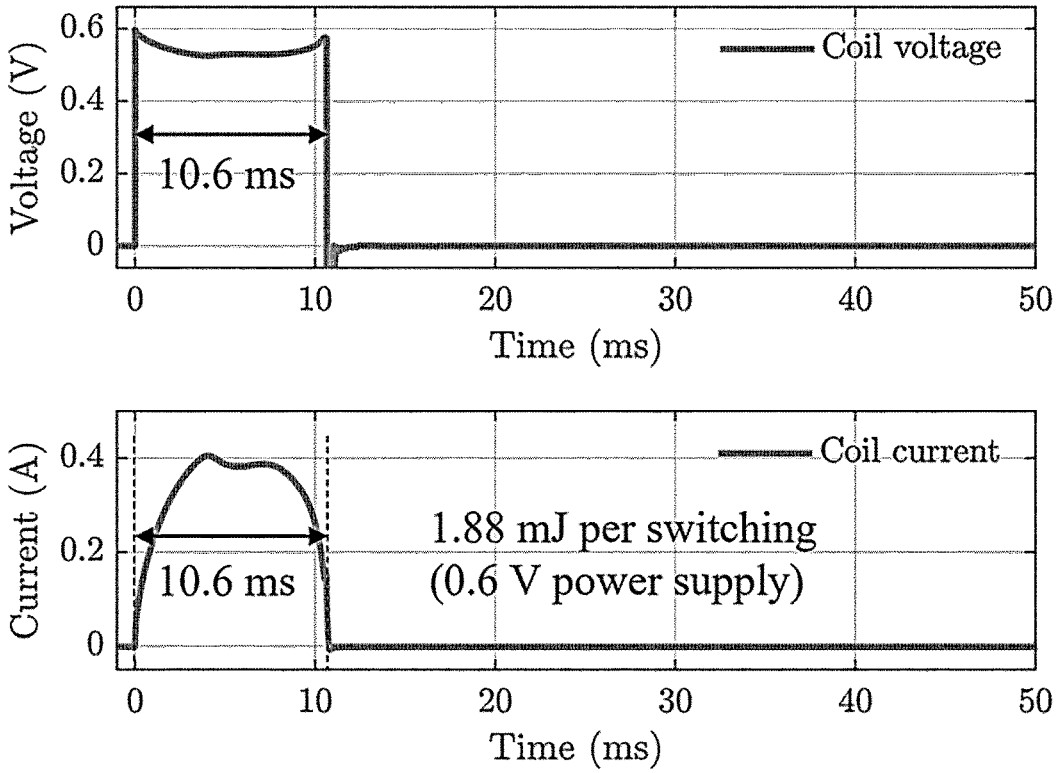
FIG. 10 shows graphs showing an electric current waveform when the micropump according to various embodiments of the present disclosure is operated.

FIG. 10 shows graphs showing an electric current waveform when the micropump according to various embodiments of the present disclosure is operated.

FIG. 10 shows graphs in which electric current consumed in the micropump 1 illustrated in FIGS. 1 to 9C is illustrated.

According to various embodiments, a voltage applied to the micropump 1 may be about 0.6 volts (V). When a voltage of about V is applied to the micropump 1, the maximum value of the electric current may be about 0.4 amperes (A). A time at which one impulse electric current (voltage) is applied may be about milli-seconds (ms). When the head portion 100 of the micropump 1 is moved from the first side to the second side, the amount of work required may be about 1.88 milli-Joules (mJ). As such, when the head portion 100 is moved from the first side to the second side, the amount of work required is significantly small. Therefore, the amount of power required to operate the micropump 1 may be significantly lower than that of other pumps. As the amount of power required to operate the micropump 1 is small, a size of the battery that supplies power to the micropump 1 may also be reduced, so that miniaturization of the micropump 1 may be realized.

A micropump (for example, the micropump 1 in FIG. 2) according to the present disclosure includes a head portion (for example, the head portion 100 in FIG. 2) and a body portion (for example, the body portion 200 in FIG. 2). The head portion includes a first movement guide (for example, the first movement guide 121), a second movement guide (for example, the second movement guide 122), and a first tip (for example, the first tip 111 in FIG. 2) formed on an outer side of the head portion. The body portion includes a core (for example, the core 211 in FIG. 2), a winding body (for example, the winding body 210 in FIG. 2) surrounding the core, a first permanent magnet (for example, the first permanent magnet 231 in FIG. 2) disposed at a lower end of a second side of the core, a second permanent magnet (for example, the second permanent magnet 232 in FIG. 2) disposed at a lower end of a first side of the core, a first fixing guide (for example, the first fixing guide 241 in FIG. 2) disposed at an upper end of the second side of the core, and a second fixing guide (for example, the second fixing guide 242 in FIG. 2) disposed at an upper end of the first side of the core. Furthermore, the first movement guide and the first fixing guide may be formed so as to correspond to each other, and the second movement guide and the second fixing guide may be formed so as to correspond to each other. Furthermore, the first permanent magnet may be disposed such that a pole of the magnet faces a lower end contact surface of the core or opposes the lower end contact surface of the core, and the second permanent magnet may be disposed such that a direction in which a pole thereof faces is the same as that of the first magnet.

According to various embodiments, when electric current is applied to the winding body in the first direction, the head portion is configured to be moved to the first side. Furthermore, when electric current is applied to the winding body in the second direction that is the direction opposite to the first direction, the head portion may be configured to be moved to the second side.

According to various embodiments, the head portion may include a second tip (for example, the second tip 112 in FIG. 2) formed on a position opposite to the first tip.

According to various embodiments, the body portion may further include a first height adjustment portion (for example, the first height adjustment portion 221 in FIG. 2) disposed at a lower side of the first permanent magnet, and may further include a second height adjustment portion (for example, the second height adjustment portion 222 in FIG. 2) disposed at a lower side of the second permanent magnet.

According to various embodiments, a tube (for example, the tube 300 in FIG. 3A) configured to be in contact with the first tip may be further included.

According to various embodiments, the tube may be configured such that the tube is disposed between the first tip and a support body (for example, the support body 400 in FIG. 3A).

According to various embodiments, a check valve (for example, the check valve 500 in FIG. 4A) disposed on the tube may be further included.

According to various embodiments, a first tube (for example, the first tube 300-1 in FIG. 3A) configured to be in contact with the first tip and a second tube (for example, the second tube 300-2 in FIG. 3A) configured to be in contact with the second tip may be further included.

According to various embodiments, a first check valve disposed on the first tube and a second check valve disposed on the second tube may be further included.

According to various embodiments, the first tube and the second tube may be configured to be connected to each other.

According to various embodiments, a third check valve disposed on the first tube or the second tube between the first check valve and the second check valve may be further included.

According to various embodiments, a capillary tube (for example, the capillary tube 510 in FIG. 9C) disposed on the first tube or the second tube between the first check valve and the second check valve may be further included.

According to various embodiments, a core (for example, the core 211 in FIG. 3A) disposed inside the winding body may be further included.

Although the present technology has been described through the above embodiments, the present technology is not limited thereto. The above embodiments may be modified or changed without departing from the spirit and scope of the present technology, and those skilled in the art can recognize that such modifications and changes also belong to the present technology.

What is claimed is:

1. A micropump comprising:

a head portion comprising a first movement guide and a second movement guide that are formed inside the head portion, the head portion comprising a first tip formed outside the head portion;

a body portion having at least a portion thereof accommodated in the head portion, the body portion comprising a core, a winding body surrounding the core, a first permanent magnet disposed at a lower end of a second side of the core, a second permanent magnet disposed at a lower end of a first side of the core, a first fixing guide disposed at an upper end of the second side of the core, and a second fixing guide disposed at an upper end of the first side of the core; and a tube configured to be in contact with the first tip, wherein the first movement guide and the first fixing guide are formed such that the first movement guide and the first fixing guide correspond to each other, the second movement guide and the second fixing guide are formed such that the second movement guide and the second fixing guide correspond to each other, wherein the first permanent magnet is disposed such that a pole thereof faces or opposes a lower end contact surface of the core, and the second permanent magnet is disposed such that a facing direction of a pole thereof is same as a facing direction of the first permanent magnet, and wherein the head portion is configured to be moved in a longitudinal direction with respect to the body portion, and according to movement of the head portion, the first tip presses at least a portion of the tube, and an inner diameter of the tube is changed, so that fluid inside the tube may flow or may not flow.

2. The micropump of claim 1, wherein the tube is configured such that the tube is disposed between the first tip and a support body.

3. The micropump of claim 1, further comprising a check valve disposed on the tube.

4. A micropump comprising:

a head portion comprising a first movement guide and a second movement guide that are formed inside the head portion, the head portion comprising a first tip formed outside the head portion; and a body portion having at least a portion thereof accommodated in the head portion, the body portion comprising a core, a winding body surrounding the core, a first permanent magnet disposed at a lower end of a second side of the core, a second permanent magnet disposed at a lower end of a first side of the core, a first fixing guide disposed at an upper end of the second side of the core, and a second fixing guide disposed at an upper end of the first side of the core, wherein the first movement guide and the first fixing guide are formed such that the first movement guide and the first fixing guide correspond to each other, the second movement guide and the second fixing guide are formed such that the second movement guide and the second fixing guide correspond to each other, wherein the first permanent magnet is disposed such that a pole thereof faces or opposes a lower end contact surface of the core, and the second permanent magnet is disposed such that a facing direction of a pole thereof is same as a facing direction of the first permanent magnet, and wherein the head portion is configured to be moved to a first side thereof when electric current is applied to the winding body in a first direction, and the head portion is configured to be moved to a second side thereof when electric current is applied to the winding body in a second direction that is a direction opposite to the first direction.

5. A micropump comprising:

a head portion comprising a first movement guide and a second movement guide that are formed inside the head portion, the head portion comprising a first tip formed outside the head portion; and a body portion having at least a portion thereof accommodated in the head portion, the body portion comprising a core, a winding body surrounding the core, a first permanent magnet disposed at a lower end of a second side of the core, a second permanent magnet disposed at a lower end of a first side of the core, a first fixing guide disposed at an upper end of the second side of the core, and a second fixing guide disposed at an upper end of the first side of the core, the body portion further comprising:

a first height adjustment portion disposed at a lower side of the first permanent magnet; and a second height adjustment portion disposed at a lower side of the second permanent magnet, wherein the first movement guide and the first fixing guide are formed such that the first movement guide and the first fixing guide correspond to each other, the second movement guide and the second fixing guide are formed such that the second movement guide and the second fixing guide correspond to each other, and wherein the first permanent magnet is disposed such that a pole thereof faces or opposes a lower end contact surface of the core, and the second permanent magnet is disposed such that a facing direction of a pole thereof is same as a facing direction of the first permanent magnet.

* * * * *